US005542748A

United States Patent [19]

Barile

[11] Patent Number: 5,542,748

[45] Date of Patent: Aug. 6, 1996

[54] QUICK RELEASE ANCHORING SYSTEM FOR A SEAT ASSEMBLY

[75] Inventor: Peter Barile, Morristown, Tenn.

[73] Assignee: Shelby Williams Industries, Inc., Morristown, Tenn.

[21] Appl. No.: 512,553

[22] Filed: Aug. 8, 1995

[51] Int. Cl.[6] ..... A47C 15/00

[52] U.S. Cl. ..... 297/463.1; 297/257; 297/344.1; 248/500; 248/501; 403/353

[58] Field of Search ..... 297/463.1, 257, 297/440.1, 344.1, 232; 248/500, 501, 503.1, 222.51; 403/353, 354, 391

[56] References Cited

U.S. PATENT DOCUMENTS

| | | | |
|---|---|---|---|
| 4,840,343 | 6/1989 | Gasser | 248/500 |
| 5,083,738 | 1/1992 | Infanti | 248/500 |
| 5,102,192 | 4/1992 | Barile, Sr. | 248/501 X |
| 5,114,112 | 5/1992 | Infanti | 248/500 |
| 5,232,191 | 8/1993 | Infanti | 248/500 |
| 5,409,296 | 4/1995 | Barile | 248/501 X |

FOREIGN PATENT DOCUMENTS

| | | | |
|---|---|---|---|
| 6105958 | 4/1994 | Japan | 297/463.1 |

*Primary Examiner*—Peter M. Cuomo
*Assistant Examiner*—Rodney B. White
*Attorney, Agent, or Firm*—Silverman, Cass & Singer, Ltd.

[57] ABSTRACT

A device for selectively anchoring a seat assembly, such as a stool or chair, relative to a fixed station, such as a gaming machine or service station. The anchoring device includes a sled or support base for the seat assembly and a quick release anchoring system or connector assembly for releasably locking the sled or support base in a desired position relative to the fixed station and limiting lateral sliding movement of the sled in its locked position. The anchoring system is operable using a very small degree of vertical lifting of the seat assembly and sled base and which is locked automatically in the mating bracket against lateral displacement from the bracket after installation of the seat assembly in the mating bracket.

10 Claims, 2 Drawing Sheets

QUICK RELEASE ANCHORING SYSTEM FOR A SEAT ASSEMBLY

FIELD OF THE INVENTION

This invention relates generally to means for selectively anchoring a seat assembly, such as a stool or chair, relative to a fixed station, such as a gaming machine or service station. More particularly, the anchoring means embodying the invention includes a sled or support base for the seat assembly and a novel quick release anchoring system or connector assembly for releasably locking the sled or support base in a desired position relative to the fixed station and limiting lateral sliding movement of the sled in its locked position.

BACKGROUND OF THE INVENTION

The herein invention provides desirable improvements over the detachable anchoring devices for a seat assembly relative to a fixed station as disclosed in U.S. Pat. Nos. 5,102,192 and 5,409,296. The named inventor Peter Barile and the assignee of these patents, Shelby Williams Industries, Inc. are common to the herein application. U.S. Pat. Nos. 4,480,343 and 4,560,200 disclose other detachable anchoring devices for a seat assembly.

In U.S. Pat. No. 4,840,343, the seating assembly comprises a chair or stool 11 which includes a seat 15 secured to the upper end of a post 12 secured upright on the support base 13 in proximity to one end of said base. The support base 13 includes an upturned edge formed at its opposite end which forms a quick release fitting 19 having a registration portion 21 which is inserted into a U-shaped channel 22 secured to a machine base 23. In order to effect removal and insertion of registration portion 21 within channel 22, the chair 11 and the end of the support base 13 opposite the fitting 19 must be lifted vertically approximately two feet (60.96 cm) off of the floor to allow flexing of the portion 26 of the U-shaped channel members 22 for installation and clearance of the registration portion 21 from within the channel member 22. The channel member 22 is open and unobstructed at its opposite lateral ends so that the registration portion 21 is capable of being inadvertently slided laterally out of the channel member where the frictional engagement of the descending portion 26 against the surface 28 is the only deterrent against such lateral displacement of the base 13 relative to the fitting 19. Applicant believes that this frictional engagement is inadequate to prevent such lateral displacement since descending portion 26 is just a simple flexible member. The so-called quick release device of U.S. Pat. No. 4,840,343 has no means for preventing the seat support from inadvertently being moved laterally out of assembly in the channel member 22 by the movement of a person on the seat 15 before a gaming machine, for instance.

Also, considering the considerable weight of the chair or stool illustrated in the U.S. Pat. No. 4,480,343, considerable force must be exerted against the chair in order to lift it from the floor approximately two feet and then carefully lowering it to the floor after the assembly is engaged in channel member 22. The same difficulty is encountered when it is desired to disengage the chair from the channel 22.

Barile U.S. Pat. No. 5,102,192 eliminated the need for lifting and lowering a somewhat heavy seat assembly 10 with its metal support base 18 in order to install the assembly opposite a station 22. The installation is achieved by sliding movement of the support base 18 toward the bracket 24 until inserted into the bracket and then a lateral sliding movement until the spring member 50 is seated within the recessed portion 54 of the upturned edge 28 of the sled base 18 to releasably lock the sled base 18 within the bracket. In U.S. Pat. No. 5,102,192, lifting of the seat assembly, as disclosed in U.S. Pat. No. 4,840,343 is eliminated and positive locking means are provided for preventing the support base 18 from sliding laterally out of engagement with the bracket 24.

The present invention provides an anchoring system having a novel quick release connector assembly for a sled base of the seat assembly which is operable using a very small degree of vertical lifting of the seat assembly and sled base and which is locked automatically in the mating bracket against lateral displacement from the bracket after installation of the seat assembly in the mating bracket.

SUMMARY OF THE INVENTION

An anchoring system for a seat assembly attached to a planar support base or sled including a quick release connector assembly for releasably connecting the planar base in a desired position relative to a fixed station. The quick release assembly includes a cooperating bracket connected to the fixed station and a connecting member on the support base constructed and arranged to be easily and readily releasably locked in the cooperating bracket. In this installed condition, the connecting member and bracket have cooperating means which prevent the support base from inadvertently sliding laterally out of the bracket.

DESCRIPTION OF THE PREFERRED EMBODIMENT

Figure 2:
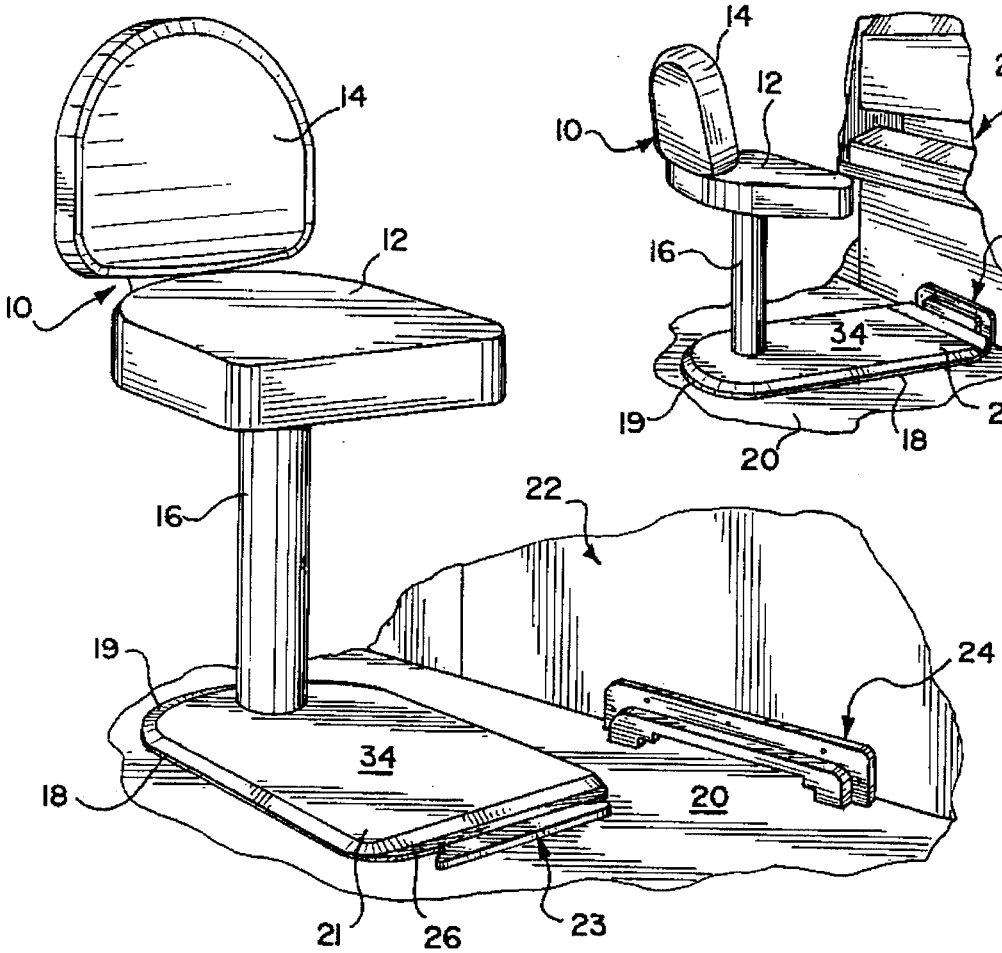
FIG. 2 is an enlarged perspective view of the chair and sled base removed from the game machine and illustrating the forward connector end of the sled base and the bracket member of the invention in detail.
Figure 1:
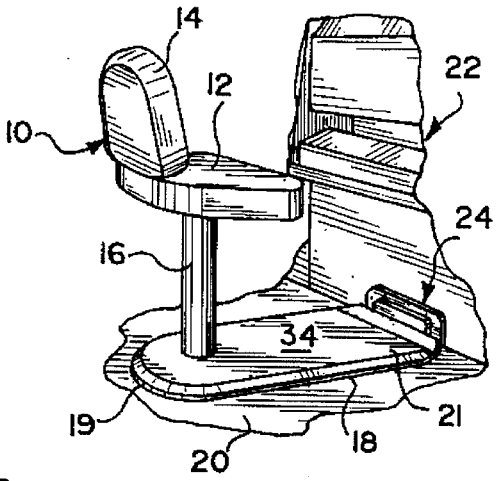
FIG. 1 is a perspective view of a seat assembly in the form of a chair installed in front of a casino game machine by means of the quick release anchoring system embodying the invention.

Referring to FIGS. 1 and 2, a chair or counter stool assembly is designated generally by the reference character 10. The chair assembly 10 includes a seat 12 to which is secured a back rest 14 and as illustrated, the seat 12 and backrest 14 can be upholstered for comfort and aesthetic appearance. A pedestal or column-type support or standard 16 has the seat and backrest combination supported at its upper end. The standard 16 is mounted on a substantially planar sled support base 18 centered adjacent the rear end 19 thereof. The chair and its support base usually is positioned on a planar floor 20 which can be carpeted.

The chair assembly 10 is operatively installed opposite a fixed station such as a casino gaming machine 22, and it is releasably connected through a quick release anchoring or connector assembly defined by mating engagement means 23 (FIG. 2) on the forward end 21 of the sled base 18 and a bracket 24 to be so engaged by means 23 as described hereinafter in detail. Alternatively, the anchoring assembly can be used to install the chair assembly 10 relative to a fixed station other than the gaming machine 22, such as, for instance, a computer installation, a service counter, a wall, a base board or other suitable member upstanding from the floor 20.

The sled base 18 preferably is constructed as an integral, planar sheet of metal or suitable composite of metal end synthetic plastic having a generally rectilinear configuration. As illustrated, rear end 19 can be ovate or squared off, but this configuration is not critical. The opposite end 21 is squared off and formed with a co-planar narrow strip-like segment 26 and an upwardly angled strip-like segment 28. The strip-like segments 26 and 28 are coextensive with the width of the plate member 18. Extending or protruding forwardly from the segment 28 is a segment 30 connected to segment 28 by the foreshortened segment 29 which serves to define a pair of ears or lugs 32 extending outwardly from opposite ends of the protruding segment 30. The segments 29 and 30 are angled together relative to the segment 28 so that its horizontal plane is parallel with the plane of the sled base 18, albeit vertically spaced above the upper surface 34 of base 18. This spacing is determined by the angular displacement of the segment 28 relative to the said flat surface 34.

The support member 16 is formed as single pedestal or standard and is connected to the base 18 proximate the oval end 19, as seen in FIG. 2.

Figure 3:
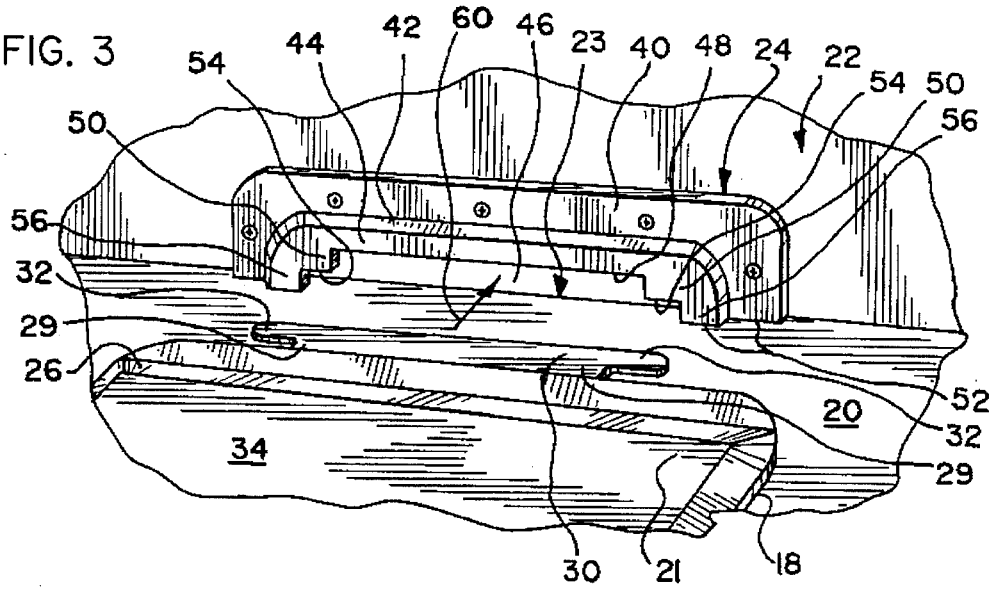
FIG. 3 is an enlarged fragmentary perspective view of the sled base in position to be inserted into the bracket member.
Figure 4:
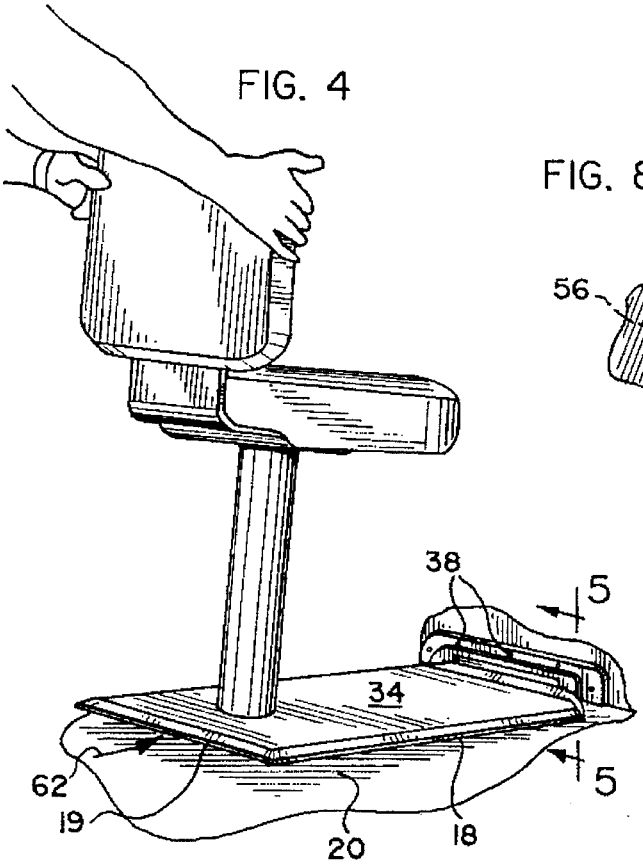
FIG. 4 is a perspective view showing the seat assembly being lifted from the floor preparatory to inserting the forward connector end of the sled base into the bracket member.
Figure 5:
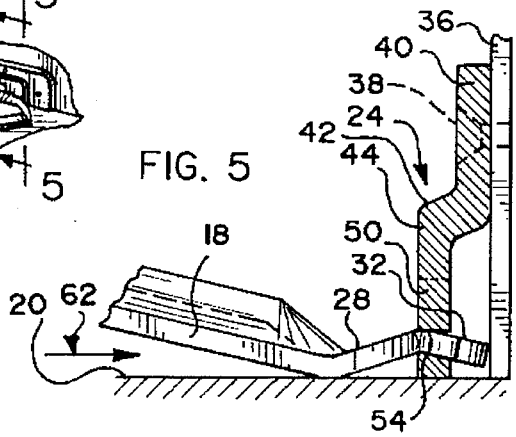
FIG. 5 is a sectional view taken through the engaged connector member and bracket along the line 5—5 of FIG, 4 and in the general direction indicated.
Figure 6:
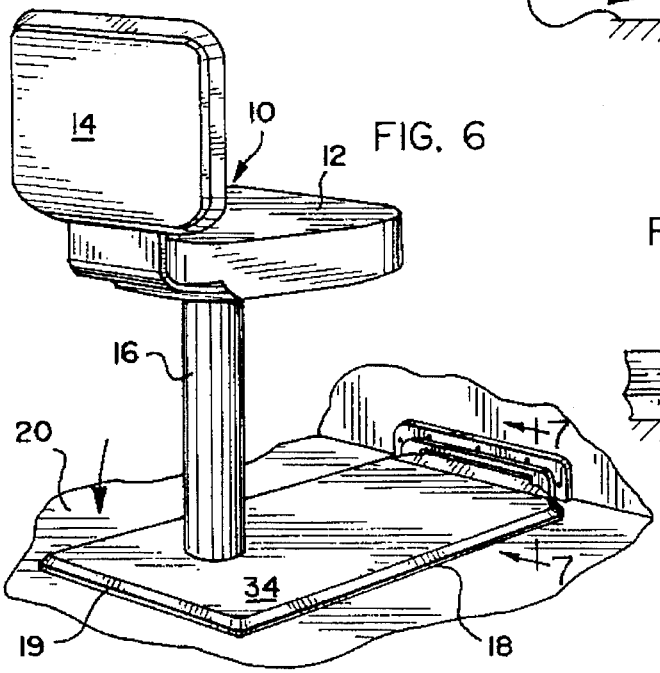
FIG. 6 is an enhanced perspective view of the seat assembly releasably anchored in the bracket member.
Figure 7:
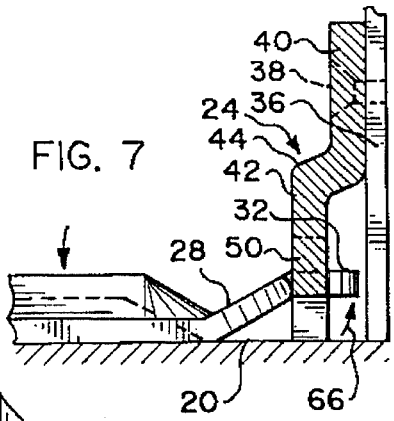
FIG. 7 is a broken sectional view taken along the line 7—7 of FIG. 6 and in the general direction indicated.

As illustrated in FIGS. 2–4, the bracket 24 is an integral, preferably cast metal structure connected to forwardly facing wall 36 of the gaming machine 22 such as by fasteners 38, seen in FIGS. 4, 5 and 7. The cross-sectional configuration of the bracket 24 can be equated to a modified Z-shaped configuration having an upper first leg or wall 40 a second leg 42 and a third lower wall or leg 44 connected to the first wall 40 by the transverse leg 42. The walls 40 and 44 are oriented spaced part laterally and in parallel planes with one another. The third wall 44 has an entrance 46 into the interior 48 of the bracket. The entrance 46 is defined by the horizontal upper wall 48 of the entrance and step-like end wall formations 50 at opposite ends of the entrance 46. The bottom end 52 of the walls 40 and 44 reach to the floor 20 in the installed condition of the bracket 24 as seen in FIGS. 2 and 3.

Figure 8:
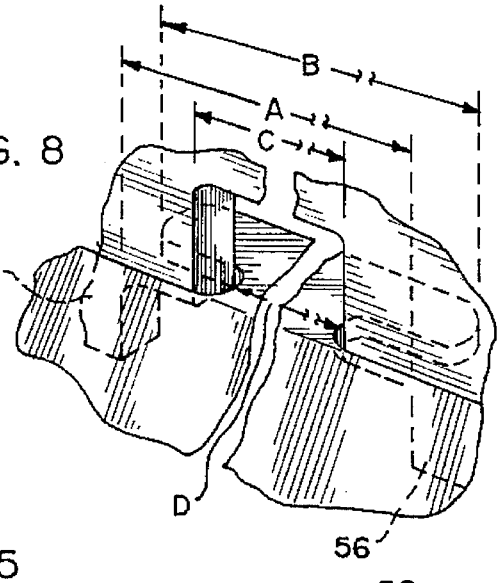
FIG. 8 is a partial diagrammatical perspective view to illustrate the mating engagement of the sled base and bracket embodying the invention and showing dimensional relationship between the matingly engaged parts.

Referring to FIGS. 3 and 8, it will be seen that the entrance 46 to the bracket 24 has certain critical dimensional relationships between the parts thereof. The largest vertical dimension is determined by the distance from the horizontal surface 48 of wall 44 to the floor 20. The shorter vertical dimension is determined by the bottom surfaces 54 of the step-like formations 50 spaced a shorter distance above the floor 20. The designated distance C between the formations 50 is less than the designated distance A between the leg-like formations 56. The designated distance B between the extremities of the lugs 32 of the segment 30 is slightly less than the dimension designated A between the leg-like formations 56 so that the lugs 32 can be inserted into the entrance 46 to pass between the inside facing surfaces of the formations 50. Further, the dimension designated B is greater than the dimension designated C and the dimension D is less than the dimension designated C, as seen in FIG. 8.

Referring to FIG. 3, the support sled 18 is aligned with the opening 46 in the bracket 24 and preparatory to be moved in the direction of the arrow 60 so as to engage the means 23 within the bracket 24. Because the segment 30 is elevated above the surface 34, and its dimension B (FIG. 8) is greater than dimension C opposite which it will be aligned when the segment 30 is moved to adjacent the entrance 46, in order to permit engagement of the means 23 with the bracket through entrance 46, the rear end 19 is lifted as shown in FIG. 4 a very short distance of approximately four inches and slided forwardly in the direction of the arrow 62. Referring to FIG. 5, as the sled base is moved forwardly in its raised condition, the lugs 32 can be passed into the bracket below the surfaces 54 of end walls 50.

Referring to FIG. 7, the end 19 of the sled base 18 is then lowered gently to the floor 20. In this movement, the lugs 32 will be moved vertically in the direction of the arrow 66 and become engaged behind the formations 50 and be prevented from being withdrawn from behind the formations 50 because the dimension designated C (FIG. 8) is less than the dimension designated B (FIG. 8). Further, the dimension designated D of the segment 29 is Just slightly less than the designated dimension C sufficiently to limit lateral displacement of the matingly engaged means 23 in the bracket 24 and thereby prevent inadvertent lateral displacement of the sled base 18 from the bracket 24.

To remove the chair from its installation, the sled base end 19 is raised a short three to four inches to lower the lugs 32 so that the sled base 18 can be withdrawn from the bracket when the lugs 32 can clear the formations 50 by passing below the surfaces 54.

It will be appreciated that installing the chair assembly 10 relative to a machine 22 by the invention described herein can be accomplished rapidly and effectively just by easily lifting the rear end of the sled base a short distance and just sliding the forward end of the sled base into the bracket and then gently lowering the rear end of the sled base to the floor. Once installed, the chair is prevented from shifting laterally in the bracket 24 and from being inadvertently displaced from the bracket by reason of the shifting of weight on the chair seat during the normal excitement generated in a player seated on the chair during play of the gaming machine. The simplicity and economy of the structure embodying the invention as well as its installation should be apparent.

I claim:

1. In a quick release anchoring device for a seat assembly vertically oriented on a horizontally planar rectilinear support base having a forward end, a quick release connector assembly for releasably connecting the support base in a desired position relative to a fixed station supported on a planar floor surface, comprising:

a. bracket means connected to said station in proximity to said floor surface, said bracket having a first wall adjacent the fixed station, a second wall extending forwardly from said first wall and providing a clearance channel therebetween;

b. said second wall having an opening therethrough to provide an entrance into said channel, said entrance being defined by a pair of connected passageways into the channel of different vertical dimensions and different lateral dimensions;

c. connecting means integrally formed on the forward end of said support base for mating engagement in the channel through said opening in the bracket means, said connecting means including a pair of lug formations of predetermined length spaced above the horizontal plane of the support base and which enables the lug formations to be inserted into the channel through only one of the passageways and thereafter to be prevented from being withdrawn from the channel through the second passageway;

wherein the lug formations are connected to the forward end of the support base by first segment angled upwardly from the horizontal plane of the support base and a second foreshortened segment oriented in a plane parallel to the horizontal plane of the support base, said lug formations being arranged adjacent said foreshortened segment and in the same plane thereof.

2. The connector assembly of claim 1 in which the forward end of the support base is required to be lifted from the planar floor surface approximately four inches to permit said lug formations to be inserted into the channel and thereafter lowered to the floor whereby to prevent withdrawal of the lug formation from the channel.

3. The connector assembly of claim 2 in which the lug formations of the foreshortened segment are conducted and arranged to engage portions of the bracket opening whereby to prevent inadvertent lateral displacement of the support base from the bracket.

4. The connector assembly of claim 2 in which said connected passageways are arranged vertically one above the other, said connected passageways comprise a lower passageway and an upper passageway, the lower passageway being longer in its lateral dimension than that of the upper passageway, said lug formations being insertable into and removable out of the channel only through said lower passageway.

5. The connector assembly of claim 4 in which said lug formations are arranged opposite the upper passageway of the connector assembly relative to the fixed station.

6. A seat assembly adapted to be releasably installed on a planar floor in a selective location relative to a fixed station, such as a machine, said assembly comprising:

a. a vertically oriented standard having a seat supported on an upper end thereof;

b. a planar rectilinear support base having said standard secured thereon contiguous one end of the base;

c. a quick release anchoring assembly for releasably installing the seat assembly in said location including, cooperating bracket means and connecting means;

d. said bracket means adapted to be installed on said station in close proximity to said planar floor;

e. said connecting means being integrally formed at an extremity of said base;

f. said bracket having a pair of adjoining passageways comprising an upper passageway and a lower passageway in a forwardly facing wall thereof of different dimensions;

g. said connecting means include a pair of spaced-apart, oppositely facing lug formations of predetermined linear dimension selected to permit the lug formations to be engaged in the bracket only through one of said passageways and prevented from being withdrawn from the bracket by said second passageway after the bracket and connecting means are releasably engaged; and h. wherein the lug formations are connected to the forward end of the support base by a first segment angled upwardly from the horizontal plane of the support base and a second foreshortened segment oriented in a plane parallel to the horizontal plane of the support base, said lug formations being arranged adjacent said foreshortened segment and in the same plane thereof.

7. The seal assembly of claim 6 in which the lug formations are spaced above and parallel to the upper surface of the support base and said passageways are arranged one above the other, the lower passageway being dimensioned to permit insertion therethrough of the lug formations into the bracket and dimensioned to prevent withdrawal of the lug formations through the upper passageway.

8. The seat assembly of claim 7 in which said lug formations are oriented in a plane opposite an upper passageway preparatory to inserting the lug formations into a lower passageway and after the lug formations are engaged in the bracket.

9. The seat assembly of claim 8 in which the said support base has a forwardly facing end and an opposite rear end, said standard and seat being secured contiguous said rear end, said connecting means being formed on said forwardly facing end, said rear end of the support base adapted to be lifted a short distance from the floor whereby the lug formations can be lowered to face the lower passageway for insertion into the bracket and raised to face the upper passageway when the rear end of the support base is lowered to the floor.

10. The seat assembly of claim 9 in which said connecting means include oppositely facing formations adapted to engage against said upper passageway whereby to prevent lateral displacement of the connecting means from the bracket.

* * * * *